United States Patent [19]

Dopson

[11] Patent Number: 4,664,324

[45] Date of Patent: May 12, 1987

[54] GRINDING MILL LINER PLATE SUPPORT

[75] Inventor: Gaylord W. Dopson, Oracle, Ariz.

[73] Assignee: Magma Copper Company, San Manuel, Ariz.

[21] Appl. No.: 765,738

[22] Filed: Aug. 14, 1985

[51] Int. Cl.[4] ..... B02C 17/22

[52] U.S. Cl. ..... 241/182; 241/300; 241/DIG. 30

[58] Field of Search ..... 51/164.1; 241/DIG. 30, 241/182, 183, 299, 300, 284

[56] References Cited

U.S. PATENT DOCUMENTS

| | | | |
|---|---|---|---|
| 2,058,257 | 10/1936 | Porteous | 83/9 |
| 2,555,171 | 5/1951 | Weston | 241/183 |
| 3,431,684 | 3/1969 | Ban | 51/164 |
| 3,880,365 | 4/1975 | Eigner | 241/182 |
| 4,032,075 | 6/1977 | Tyer | 241/45 |
| 4,194,710 | 3/1980 | Ebner | 241/182 |
| 4,211,369 | 8/1980 | Eigner | 241/182 |
| 4,270,705 | 6/1981 | Larsen | 241/182 X |
| 4,485,975 | 12/1984 | Eigner | 241/182 |

*Primary Examiner*—Mark Rosenbaum
*Attorney, Agent, or Firm*—Pennie & Edmonds

[57] ABSTRACT

A cylindrical grinding mill liner plate support comprising a base portion; means for securing the base portion to the shell of the grinding mill; replaceable corner bumpers detachably secured to each interior longitudinal edge of the base portion; and at least one side panel assembly, detachably secured to at least one side of the base portion. A cylindrical grinding mill liner comprising a plurality of liner plate supports placed in parallel courses along the longitudinal axis of the grinding mill which converts the heretofore circular cross-section of the hollow milling space into a polygonal, preferably square, cross-section.

19 Claims, 5 Drawing Figures

GRINDING MILL LINER PLATE SUPPORT

TECHNICAL FIELD

The present invention relates generally to cylindrical grinding mills and particularly to a method and apparatus for changing the internal liner configuration of a grinding mill in order to increase its grinding efficiency and to protect the outer shell of such grinding mills from abrasive wear.

BACKGROUND ART

The conventional prior-art linings, utilized for the protection of the shell of cylindrical grinding mills against the wearing action of the materials placed therein, change the shape of an originally circular cross-sectional grinding mill into the shape of a square with rounded corners.

The method generally utilized by the prior-art was to place cylindrical segments or truncated cylindrical segments between the shell of the grinding mill and the wear liners of the mill. These segments were hollow and normally were fabricated out of soft steel plate. As the hard alloy wear liners which were placed on the cylindrical segments began to wear out, these segments became exposed to the charge contained in the grinding mill, which would then wear through the exposed portion of the soft steel cylindrical segment. Upon being admitted into the hollow cylindrical segment, the charge had a tendency to wear into and through the curved portion, resulting in eventual grinding mill shell damage.

Various methods were utilized in an attempt to overcome these difficulties. U.S. Pat. No. 2,058,257 to Porteous describes means for securing rubber linings to the interior of the metal shell of a cylindrical grinding or crushing mill. The rubber linings are detachably retained against the surface of the metal shell by utilizing rubber-covered metal bars of substantially the same thickness as the rubber covered lining, thereby presenting a rubber surface of uniform thickness to the charge of material within the metal shell and ensuring that the life of the retaining bars is substantially the same as the life of the lining.

U.S. Pat. No. 3,431,684 to Ban discloses a rotary abrading device consisting of a drum, sealed at both ends, which is rotatable about its axis. The drum is provided with a plurality of grate surfaces forming a polygon within the drum which are loosely mounted along the inner surface of the drum so as to oscillate or jangle as the drum revolves. The grates are spaced from the inner surface of the drum and means exist for the introduction of particulate matter at the upper end of the drum while abraded particles and fines are discharged from separate discharge elements at the lower end of the drum.

U.S. Pat. No. 3,880,365 to Eigner discloses a mill having a shell which has an interior polygonal, preferably square, cross-section with rounded corners. The interior of the mill is lined by plates arranged in a series of annular courses, arranged one behind the other, at least a portion of which are inclined toward the axis and a portion of which are parallel to the axis, with adjacent courses being angularly displaced.

The helical passage formed within the mill by the offset annular courses has a sorting action on the grinding elements so that most of the larger grinding elements collect at the mill inlet end while most of the smaller grinding elements collect near the mill outlet end.

The grinding action is strongly influenced by the selection of a proper radius for the rounded corner of the shell lining. A decrease of the radius of the rounded portion relative to the diagonal measure of the cross-section of the mill results in more effective impacts upon the contents of the mill by the grinding bodies while an increase in the radius of the rounded portions has the opposite effect.

U.S. Pat. No. 4,032,075 to Tyer relates to a multi-chambered apparatus having a polygonal cross-section for scrubbing gravels and substances containing heavy precious metals. The apparatus is supported at an angle by a frame and it is adaptable to be driven by a variable speed drive system. Each section is separated from adjacent sections by a retainer ring having a circular interior opening which is preferably smaller in area then the cross-sectional area of the polygonal interior of the preceeding, up-stream scrubber section. The interior wear plates comprising the polygonal lining are removable and replaceable if they become worn or damaged.

U.S. Pat. No. 4,194,710 to Ebner relates to a tumbling mill with a generally polygonal, preferably square liner on the interior of the shell. At the corners, the liner plates are directly supported on the inside surface of the shell while elsewhere they are supported by spacers. The liner plates may have elevations, such as ribs or undulations, which cross the axis of rotation of the shell. The liner plates, which extend along elliptic arcs on the inside of the shell are amenable to individual replacement.

U.S. Pat. No. 4,211,369 to Eigner relates to a lining for tube or ball mills for wet or dry grinding systems. The lining is made up of a series of rings surrounded and distributed along the axis of the shell which are angularly offset, one with respect to the next, in a haphazard, nonuniform manner. Each of the rings defines an interior hollow space which has the configuration of a star having rounded points. Further, between the rounded star points, the hollow interior space of the mill has inwardly extending sharp corners to further reduce the amount of dead space in the interior of the mill and increase the number of impacts per revolution of the mill between the milling bodies and the material to be milled.

Finally, U.S. Pat. No. 4,485,975 to Eigner discloses an alternate apparatus for lining the interior surface of the shell of a tumbling mill. The lining includes a plurality of spaced liner rings which consist of interfitted liner plates and securing rings, each having a wedge-shaped cross-section and being situated between a pair of adjacent liner rings so that each liner ring is retained in position by a pair of securing rings. The securing rings themselves are fixed to the shell of the tumbling mill by bolts or the like.

The applicants have now discovered a novel and unobvious protective liner plate support for the shells of cylindrical grinding mills by developing an improved cylindrical segment, that may or may not be truncated, which is placed between the outer cylindrical grinding mill shell and the interior lining. The wear pieces of the cylindrical segment are easily replaced, which is a further advantage over the prior art.

SUMMARY OF THE INVENTION

The invention relates generally to cylindrical grinding mills and particularly to a method and apparatus for changing the internal liner configuration of a grinding mill from a circular to a square configuration.

The apparatus for changing the configuration of the grinding mill liner is a liner plate support which comprises a base portion which is a cast or molded elastomeric material and is configured so that its bottom conforms to the curvature of the outer shell of the mill, means for securing the base portion to the shell of the grinding mill, a replaceable corner bumper which is detachably secured to each interior longitudinal edge of the base portion and at least one side panel assembly which is removably secured to at least one side of the base portion.

The liner plate support may be secured to the outer shell of the grinding mill by means of at least one pedestal, which is a metal enclosed channel extending vertically through the base portion, positioned and configured for the passage of attachment means such as bolts which communicate and are aligned with matching openings on the surface of the outer shell and which are then secured with nuts.

The replaceable corner bumpers are detachably secured to the base portion by the passage of attachment means such as a bolt, which extends from a longitudinal extruded aluminum bracket, located on the upper longitudinal corner of the base portion, through small diameter pipes around which the rubber or other elastomeric material of the bumper has been cast or molded, and which is secured on its upper surface by a nut.

The side panel assembly of the liner plate support comprises a pre-cut steel plate, shaped to cover a side of the base portion perpendicular to the shell of the grinding mill, a curved steel rocker plate which is attached along the edge of the side plate which is proximal to the outer shell of the mill, a plurality of vertical metal vanes projecting from the curved rocker plate and attachment means for securing the side panel assembly to the base portion.

The attachment means for securing the side panel assembly to the base portion of the liner support is preferably at least one bolt which extends from the side of a longitudenal extruded aluminum bracket on the upper longitudinal corner of the base portion, through holes in the pre-cut side plate where it is secured by a nut.

The rocker plate with its plurality of vertical vanes is attached to the side panel assembly so as to prevent the racing of small ore particles along the shell of the mill in the gaps between the parallel courses of liner plate supports. The side panel assembly may be coated with rubber to resist wear on its exposed surfaces.

A cylindrical grinding mill liner may be constructed by placing a plurality of the liner plate supports in parallel courses along the longitudinal axis of a grinding mill and covering the liner supports with a wear liner constructed of steel, cast iron, or a ceramic or other refractory material.

Such a liner plate support converts the circular cross-sectional milling space in the base of the mill into a polygonal cross section. This cross-sectional area may be defined by at least 3 but not more than 6 sides, but the preferred member is 4 sides of equal length which gives rise to a square cross-sectional area.

Use of the liner plate supports and wear liners as described above allow the construction of a cylindrical grinding mill comprising a cylindrical shell, means for rotation of that shell and a plurality of the liner plate supports, each covered by a wear liner, arranged in parallel courses so as to provide a square cross-sectional grinding area.

BRIEF DESCRIPTION OF THE DRAWINGS

Further benefits and advantages of the invention will become apparent from a consideration of the following description given with reference to the accompanying drawing figures which specify and show preferred embodiments of the present invention, wherein.

DETAILED DESCRIPTION OF THE PREFERRED EMBODIMENTS

This invention relates to cylindrical rotating grinding mills, particularly, it relates to the wear lining systems used in such grinding mills. More particularly, it relates to the method of altering the cylindrical shape of the grinding surface of the mill to the shape of a square, wherein the edges of the square which define the milling space in the base of the cylindrical grinding mill present a rounded appearance when viewed along the longitudinal axis of the mill.

In a known grinding mill arrangement the cylindrical grinding mill is lined with a removable hard alloy material in order to protect the grinding mill shell from wear. In the typical grinding mill, the shape of the wear surface is cylindrical, however the inside surfaces of the individual wear liner pieces may be of a modified shape in order to increase the grinding efficiency of the mill.

Accordingly it is the objective of this invention to provide an improved method of creating the shape of a square in a plurality of liner courses-each of a specified width and having rounded interior corners as viewed along the longitudinal axis of the cylindrical grinding mill, which is an improvement over the previous method of creating such liner courses. In accordance with the general features of the invention, a method of creating such liner courses with rounded corners is provided for a cylindrical grinding mill.

These objectives are achieved by the use of novel wear liner supports as will be described hereinbelow.

Figure 1:
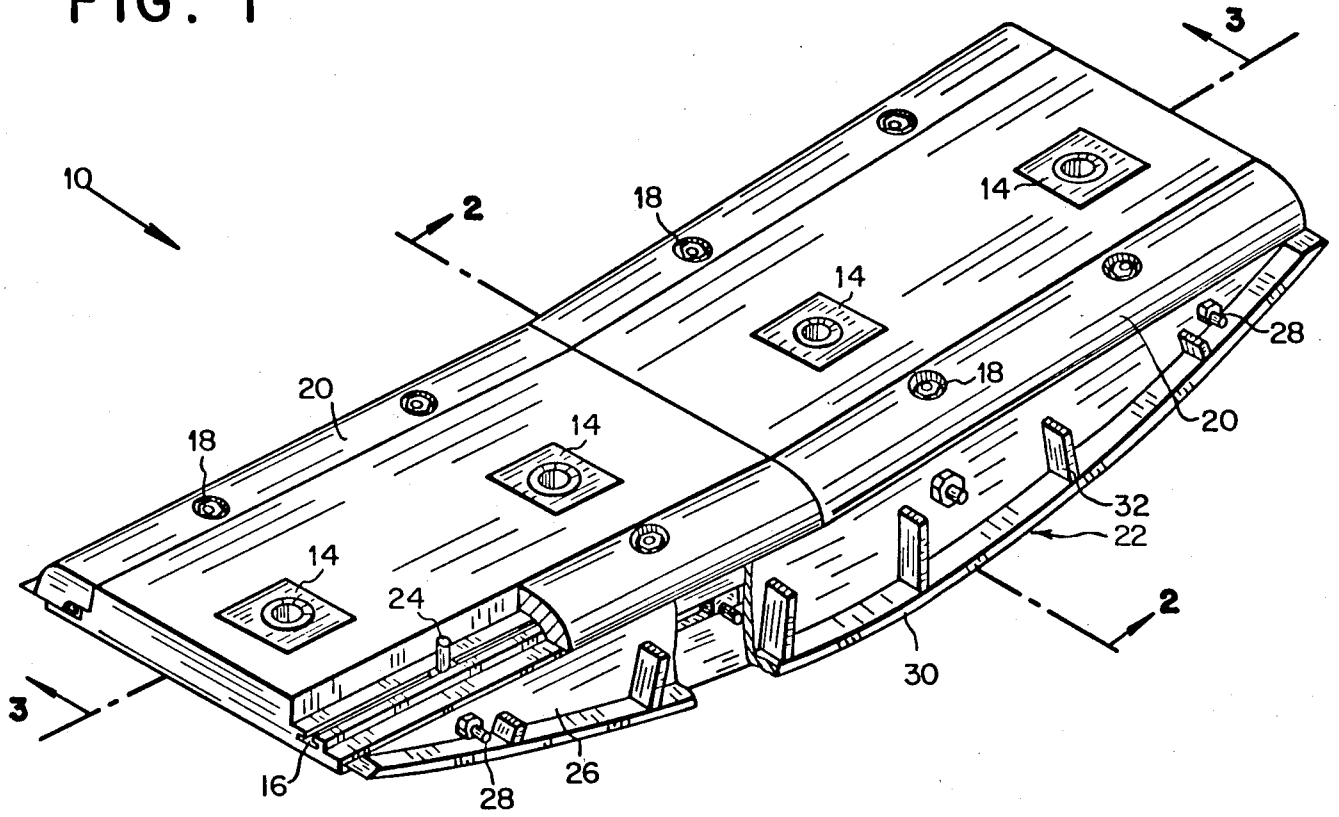
FIG. 1 is a perspective plan view of a cylindrical grinding mill liner support.

Referring initially to FIG. 1, there is illustrated a cylindrical grinding mill liner support 10 which is comprised of several segments. The base portion 12 is formed by casting or molding a resilient material, preferably rubber or some other elastomeric substance into a shaped cylindrical segment. The base portion 12 is formed around pedestals 14 which are preferably fabricated out of steel plate and steel pipe, and are spaced in such a manner to facilitate attachment means such as a bolt 36 which passes through the wear liner plate 34, pedestal 14 and grinding mill shell (not shown) to secure the plate 34 and support 10 to the grinding mill shell.

Longitudinal brackets 16 preferably of extruded aluminum are securely attached to the base portion 12.

These longitudinal brackets 16 are used to provide an area for attachment means such as bolts 18 which attach the replaceable corner bumpers 20 and the side panel assembly 22 to the base portion 12. The corner bumpers 20 are also preferably constructed of rubber or some other elastomeric material which is cast or molded around small diameter pipes 24. The purpose of these small diameter pipes 24 is to securely fasten the corner bumpers 20 to the base portion 12 utilizing attachment means such as bolts 18 inserted into the extruded aluminum longitudinal brackets 16, extending through the corner bumpers 20 and secured by nuts 42. The extruded aluminum longitudinal brackets 16 are either secured to the base portion 10 in the molding operation or by the use of a suitable adhesive.

The side panel assembly 22 is preferably fabricated out of steel plate which may be covered with rubber to resist abrasion. The main portion 26 of the side panel assembly 22 is a perforated plate wherein the holes in the plate serve as channels for the passage of attachment means such as bolts 28 through the side panel assembly 22 which couple with the channel 40 of an extruded aluminum longitudinal bracket 16 located on the base portion 12.

The main portion 26 of the side panel assembly 22 has a curved steel rocker plate 30 welded along the bottom edge. This plate is also preferably coated with rubber to reduce the abrasive impact of the ore contacting the plate. The purpose of the rubber covered curved steel rocker panel 30 is to protect the grinding mill shell (not shown) from wear caused by small ore particles which may work their way in between the liner segments. As can be appreciated by one skilled in the art, each course of the liner is installed separately, and the provision of a few inches of space between each course facilitates the installation of the liner without requiring the need for critical tolerances.

The curved steel rocker panel 30 has projecting vertical metal vanes 32 which may be covered with rubber and which deflect the ore particles and prevent any racing of the ore charge along the interior of the mill between adjacent liner segments 10.

Figure 2:
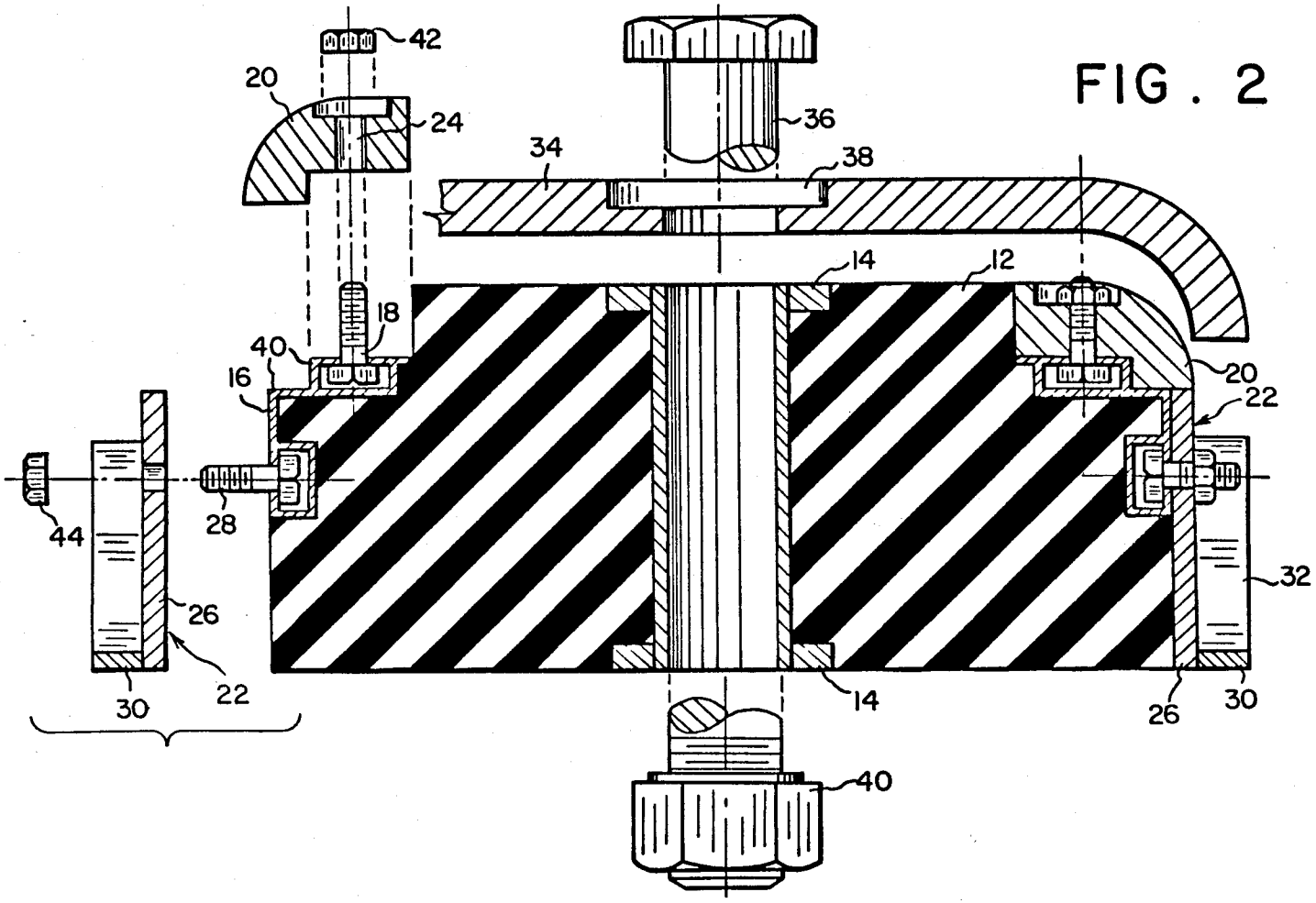
FIG. 2 is a partially exploded cross-sectional view taken along lines A—A of FIG. 1.

As illustrated by the partially exploded cross-sectional view of FIG. 2, the wear liner plate 34 which is preferably constructed of steel, cast iron, ceramic or some other refractory material, rests on the upper face of the base portion 12 in order to protect the comparatively soft surface of the base 12 from abrasive wear caused by the repeated impacts of the ore charge as the grinding mill revolves. The wear liner plate 34 is secured against the upper face of the base portion 12 by attachment means such as a a bolt 36 which passes through an aperture 38 in the wear liner plate 34 as well as through the pedestal 14 molded or cast into the base portion 12, which is then secured against the outer shell of the mill (not shown) by means of a nut 40.

Likewise, the corner bumpers 20 are secured along the upper longitudinal edges of the base portion 12 by attachment means such as a bolt 18 passing through a small diameter pipe 24 in the bumpers and engaging the channels 40 in the extruded aluminum longitudinal brackets 16 which are attached to the upper face of the base portion 12. The head of the bolt 36, which secures the wear liner plate 34 and the nuts 42 which secure the corner bumpers 20 to the base portion 12 are counter sunk below the surface level so as not to protrude and risk being worn or snapped off by the abrasion or impact of tumbling ore fragments.

The side panel assembly 22 is also attached to the base portion 12 by means of bolts 28 which extend from channel 40 on extruded aluminum longitudinal bracket 16, through a perforation in the main portion 26 of the side panel assembly 22 which is then secured by means of a nut 44.

A plurality of vertical metal vanes 32 extends perpendicularly from the rocker panel 30 which is welded at the base of the side panel assembly 22. Preferably, the rocker panel 30, with a curvature corresponding to that of the outer shell of the grinding mill, protects the outer shell from wearing caused by the racing of ore particles around the inner surface of the shell as the mill rotates.

This panel 30 is necessary since there is usually some slight gap between the courses of liner supports 10, the width of which depends upon the accuracy of the measurements made and the manufacturing tolerances allowed. Preferably, this gap, which facilitates the installation and/or removal of the liner plate supports, should not be more than about ½ inches. The metal vanes 32 serve to deflect the larger ore particles and direct them onto the milling surface rather than allowing them to wedge between the liner supports 10.

Figure 3:
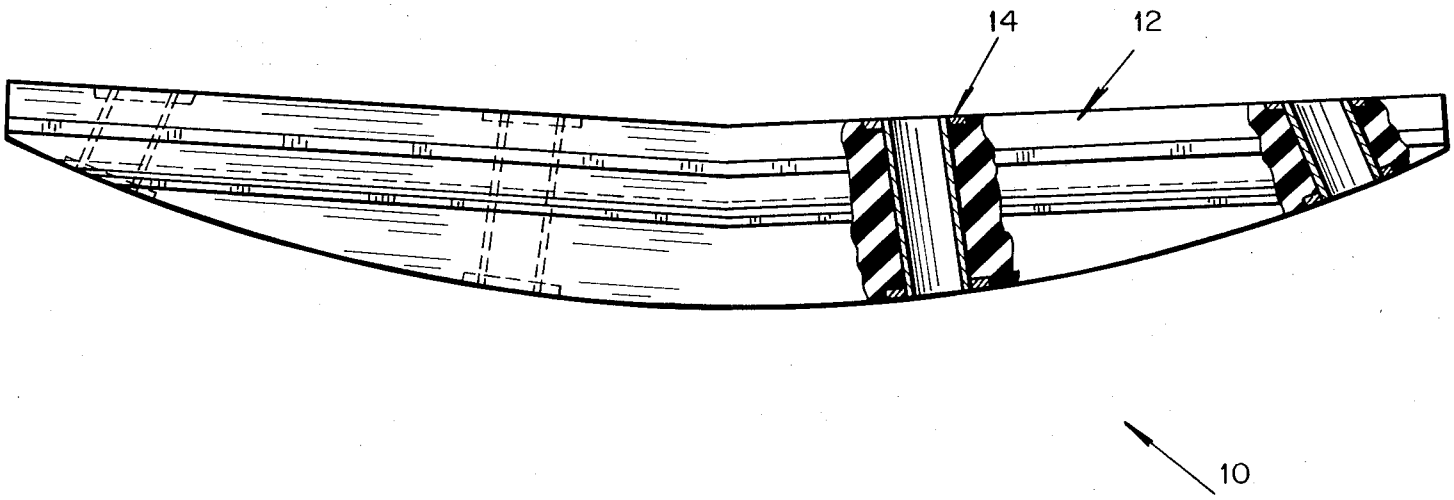
FIG. 3 is a longitudinal cross-sectional view along lines B—B of FIG. 1.

As is clearly illustrated by the longitudinal cross-sectional view of FIG. 3, the pedestals 14 are fabricated out of steel plate supports and steel pipe and these provide a channel for the bolts 36 attaching the wear liner 34 and the base portion 12 to the outer shell of the grinding mill (not shown).

Figure 4:
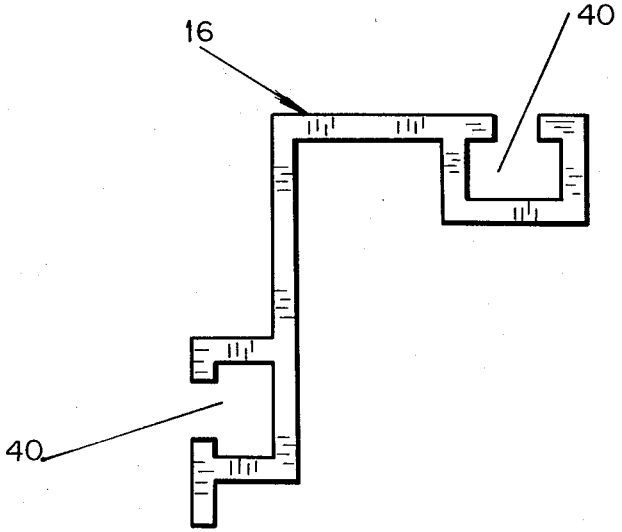
FIG. 4 is an enlarged view of a longitudinal bracket as shown in FIG. 2.

FIG. 4 is an enlarged view of an extruded aluminum longitudinal bracket 16. There are channels 40 formed on either side of the longitudinal bracket 16 which serve to position and hold bolts 28, 18 which secure the side panel assemblies 22 and corner bumpers 20 on both the front and rear of each grinding mill liner support 10. The chord length and height (thickness) of each cylindrical liner support 10 may also be adjusted in order to maximize the grinding efficiency of the mill.

Figure 5:
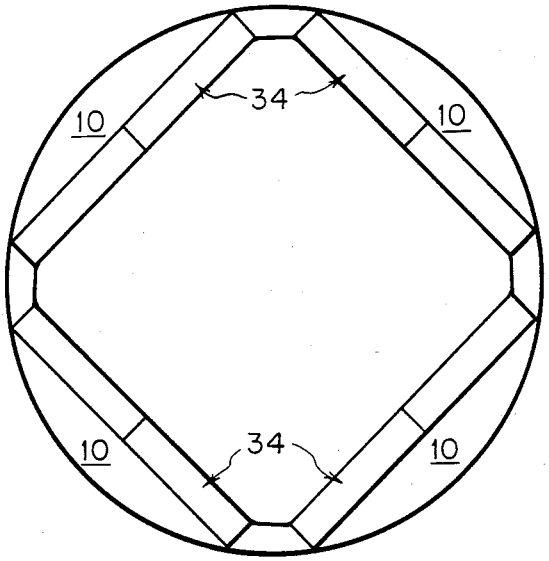
FIG. 5 is a cross-sectional view of the interior of a grinding mill utilizing the liner support of the present invention.

FIG. 5 is a cross-sectional view of the interior of a grinding mill which illustrates the location of liner support 10 between the outer shell of the grinding mill and the wear liner plates 34. A plurality of courses of liner plate supports 10, having the configuration depicted and claimed herein, may be installed within the grinding mill so as to modify the circular cross-section of the mill into a polygonal shape and thereby increase the grinding efficiency of the mill as modified.

In alternate embodiments, the top surface of the base portion 12 which is protected by the wear liner plate 34 can be either a plane or a curved surface but the preferred embodiment is the bisection of two planes as illustrated in FIG. 1. The wear liner plate 34 extends across the top surface of the base portion 12, over the corner bumpers 20 and to the top of the metal vanes 32.

A further advantageous feature of the invention is the method of construction and assembly in which individual liner support segments 10 and various constituent portions of these liner supports 10, such as the wear plate 34 and corner bumpers 20, are easily removable in situations where damage or normal wear requires their replacement or repair.

While it is apparent that the invention herein disclosed is well calculated to fulfill the desired results, it will be appreciated that numerous modifications and embodiments may be devised by those skilled in the art, and it is intended that the appended claims cover all such modifications and embodiments as fall within the true spirit and scope of the present invention.

I claim:

1. A cylindrical grinding mill liner plate support comprising:

a base portion cast or molded around a plurality of openings extending vertically through said base portion, each of said openings positioned and configured for the passage of attachment means through the base portion;

means for securing lining means to said base portion, said securing means extending through said openings in said base portion to a cylindrical grinding mill outer shell;

a replaceable corner bumper detachably secured to each interior longitudinal edge of the base portion; and at least one side panel assembly removably secured to at least one side of the base portion said side panel assembly having a curved rocker plate attached along the edge of the side panel proximal to the shell of the mill.

2. The liner plate support of claim 1 wherein the base portion is a cast or molded elastomeric material.

3. The liner plate support of claim 1 which further comprises means for removably securing the replaceable corner bumpers to the base portion.

4. The liner plate support of claim 3 wherein the means for removably securing the corner bumpers along each interior longitudinal edge of the base portion is a longitudinal aluminum bracket positioned and configured for the passage of attachment means.

5. A cylindrical grinding mill comprising:

a cylindrical shell;

means for rotation of the shell;

a plurality of liner plate supports each comprising:

a base portion cast or molded around a plurality of open vertical channels configured so that the bottom of the base portion conforms to the curvature of the outer shell of the mill;

means for detachably securing the base portion to the outer shell of the grinding mill;

at least two longitudinal brackets attached to the interior longitudinal edges of the base portion, each bracket configured and adapted for the passage of the attachment means;

at least two replaceable corner bumpers, each comprising a rubber pad, cast or molded around a plurality of pipe means;

means to removably attach each corner bumper to a longitudinal bracket of the base portion; and at least two side panel assemblies comprising sheet cut to cover the sides of the base portion not in contact with the liner shell, a curved steel rocker plate secured to that portion of the side plate proximate to the outer shell of the mill and configured to correspond to the curvature of the outer shell, said rocker plate having a plurality of vertical vanes positioned so as to prevent the racing of small ore particles along the shell of the mill in gaps between th parallel courses of liner plates, said side plate assembles being coated with rubber on all exposed surfaces; and a wear liner plate attached to and covering the top surface of each liner plate support.

6. A cylindrical grinding mill liner plate support comprising:

a base portion constructed of a cast or molded elastomeric material;

at least one opening extending vertically through the base portion, positioned and configured for the passage of attachment means through the base portion;

a replaceable corner bumper removably secured to each interior longitudinal edge of the base portion; and at least one side panel assembly comprising:

a pre-cut side plate, shaped to cover a side of the base portion perpendicular to the shell of the grinding mill;

a curved steel rocker plate attached along the edge of the side plate proximal to the shell of the mill;

a plurality of vanes projecting vertically from the rocker plate; and means for removably securing the side panel assembly to the base portion, said entire side panel assembly including a rubber coating for wear resistance.

7. The liner plate support of claim 6 wherein the means for removably securing the side panel assembly to the base portion comprises attachment means passing through the side panel assembly and engaging the bracket means of the base portion.

8. The liner plate support of claim 7 wherein the replaceable corner bumpers are formed by casting or molding an elastomeric material around a plurality of pipe means.

9. The liner plate support of claim 8 further comprising attachment means for removably attaching each corner bumper to the upper longitudinal edge of the base portion; said attachment means passing through the pipe means of the corner bumpers.

10. The liner plate support of claim 9 wherein the base portion is formed by casting or molding an elastomeric material around at least one pedestal means.

11. The liner plate support of claim 10 which further comprises means for attaching the side panel assembly to the interior longitudinal edges of the base portion.

12. A liner plate support for a cylindrical grinding mill comprising:

a base portion cast or molded around a plurality of open vertical channels configured so that the bottom of the base portion conforms to the curvature of the outer shell of the mill;

means for detachably securing the base portion to the outer shell of the grinding mill;

at least two longitudinal brackets attached to the interior longitudinal edges of the base portion, each bracket configured and adapted for the passage of attachment means;

at least two replaceable corner bumpers, each comprising a cylindrical rubber pad, cast or molded around a plurality of pipe means;

means to removably attach each corner bumper to a longitudinal bracket of the base portion; and at least two side panel assemblies comprising sheet cut to cover the sides of the base portion not in contact with the liner shell, a curved steel rocker plate secured to that portion of the side plate proximate to the outer shell of the mill and configured to correspond to the curvature of the outer shell, said rocker plate having a plurality of vertical vanes positioned so as to prevent the racing of small ore particles along the shell of the mill in gaps between the parallel courses of liner plates, said side plate assemblies being coated with rubber on all exposed surfaces.

13. A cylindrical grinding mill liner comprising:

a plurality of liner plate supports each comprising:
a base portion;
means for securing lining means to said base portion, said securing means extending through the base portion to a cylindrical grinding mill outer shell;
a replaceable corner bumper detachably secured to each interior longitudinal edge of the base portion; and,
at least one side panel assembly, removably secured to at least one side of the base portion, said supports placed in parallel courses along the longitudinal axis of the grinding mill to convert the heretofore circular cross-section of the hollow milling space into a polygonal cross section; and
a wear liner plate removably secured to each liner plate support.

14. A cylindrical grinding mill liner comprising:
a plurality of liner plate supports each comprising:
a base portion cast or molded around a plurality of open vertical channels configured so that the bottom of the base portion conforms to the curvature of the outer shell of the mill;
means for detachably securing the base portion to the outer shell of the grinding mill;
at least two longitudinal brackets attached to the interior longitudinal edges of the base portion, each bracket configured and adapted for the passage of the attachment means;
at least two replaceable corner bumpers, each comprising a rubber pad, cast or molded around a plurality of pipe means;
means to removably attach each corner bumper to a longitudinal bracket of the base portion; and
at least two side panel assemblies comprising sheet cut to cover the sides of the base portion not in contact with the liner shell, a curved steel rocker plate secured to that portion of the side plate proximate to the outer shell of the mill and configured to correspond to the curvature of the outer shell, said rocker plate having a plurality of vertical vanes positioned so as to prevent the racing of small ore particles along the shell of the mill in gaps between the parallel courses of liner plates, said side plate assembles being coated with rubber on all exposed surfaces, said liner supports placed in parallel courses along the longitudinal axis of the grinding mill to convert the heretofore circular cross-section of the hollow milling space into a polygonal cross section; and
a wear liner plate removably secured to each liner plate support, said wear liner extending over said corner bumpers.

15. A cylindrical grinding mill lining comprising:
a plurality of parallel courses of liner plate supports each of which comprises:
a base portion cast or molded around a plurality of open vertical channels and configured so that its bottom conforms to the curvature of the outer shell of the mill, said base portion detachably secured to the liner shell;
at least two longitudinal brackets attached to the interior longitudinal edges of the base portion and configured and adapted for the passage of attachment means;
at least two replaceable corner bumpers each comprising a rubber pad, cast or molded around a plurality of pipe means, said bumpers removably attached to the longitudinal brackets of the base portion;
at least two side panel assemblies comprising a sheet cut to cover the sides of the base portion not in contact with the liner shell, a curved steel rocker plate secured to that portion of the side plate proximate to the outer shell of the mill and configured to correspond to the curvature of the outer shell, said rocker plate having a plurality of vertical vanes positioned so as to prevent the racing of small ore particles along the shell of the mill in gaps between the parallel courses of liner plates said side plate assemblies being coated with rubber on all exposed surfaces; and
at least one wear liner plate removably attached to the upper surface of each base portion of each of said liner supports.

16. The grinding mill lining of claim 15 wherein the polygonal cross-section of the hollow milling space is defined by at least three but not more than 6 of said liner plate supports.

17. The grinding mill lining of claim 16 wherein the polygonal cross-section of the hollow milling area is defined by four of said liner supports, each being of equal length.

18. The cylindrical grinding mill lining of claim 17 wherein the wear liner is constructed of steel, cast iron, or a ceramic or refractory material.

19. A cylindrical grinding mill comprising:
a cylindrical shell;
means for rotation of the shell;
a plurality of liner plate supports each comprising:
a base portion;
means for securing lining means to said base portion, said securing means extending through the base portion to a cylindrical grinding mill outer shell;
a replaceable corner bumper detachably secured to each interior longitudinal edge of the base portion; and
at least one side panel assembly removably secured to at least one side of the base portion, said liner plate supports arranged so as to form a polygonal cross-sectional milling area in the bore of the grinding mill; and
a wear liner plate covering the top surface on each liner plate support which plate is constructed of a material to withstand the abrasive impact of grinding bodies or ore fragments.

* * * * *